US007168703B2

(12) United States Patent
Lammertink

(10) Patent No.: US 7,168,703 B2
(45) Date of Patent: Jan. 30, 2007

(54) PUZZLE GAME INCORPORATING A ROTATIONAL ELEMENT AND METHODS OF PLAYING THEREOF

(76) Inventor: Ferdinand Lammertink, E. Verkade Str 15, Hengelo (NL) 7558 TH ( * ) Notice: Subject to any disclaimer, the term of this patent is extended or adjusted under 35 U.S.C. 154(b) by 23 days.

(21) Appl. No.: 11/151,653

(22) Filed: Jun. 14, 2005

(65) Prior Publication Data

US 2006/0279041 A1 Dec. 14, 2006

(51) Int. Cl.
*A63F 9/08* (2006.01)

(52) U.S. Cl. ..... 273/153 S

(58) Field of Classification Search ..... 273/153 S, 273/153 R; 463/9, 11; 434/171–175
See application file for complete search history.

(56) References Cited

U.S. PATENT DOCUMENTS 332,211 A * 12/1885 Protheroe ..... 273/153 S
3,767,202 A * 10/1973 Sternad ..... 273/153 S
4,412,681 A * 11/1983 Irwin ..... 273/153 S
4,418,914 A * 12/1983 Bauer ..... 273/153 S
4,479,654 A * 10/1984 Moscovich ..... 273/153 S
4,983,062 A * 1/1991 Hour ..... 273/153 S
5,542,673 A * 8/1996 Lammertink ..... 273/153 S
6,638,072 B1 * 10/2003 Sarconi ..... 273/153 S

* cited by examiner

*Primary Examiner*—Steven Wong

(57) ABSTRACT

A puzzle game and method of playing provides for sequentially ordering a plurality of tiles that are originally oriented in a random pattern, and where a rotational element is included to increase the challenge. The game includes a frame with a central horizontal shaft defining a plurality of slide rows. A plurality of tiles are slideable along the horizontal axis within each of the plurality of slide rows, each of the plurality of tiles having a design on a front facing portion of the tile and an inverted form of the design on a rear facing portion of the tile. A sub-frame is rotatably mounted in the frame for rotating about the shaft. When the player rotates the sub-frame by one-hundred eighty degrees during game play, the plurality of slide rows containing a sub-set of the plurality of tiles are oriented such that the rear facing portions of the sub-set of the plurality of tiles are viewable from the front facing portion of the frame, and the plurality of slide rows are inverted as viewed along the vertical axis. Using the puzzle game, a player slides the tiles in each row left or right along the horizontal axis. The player selectively rotates the sub-frame to orient the slide rows and corresponding tiles in a different position as viewed along the vertical axis. The sliding and rotating steps are repeated until the designs on the tiles are positioned in a logical or sequential pattern.

12 Claims, 6 Drawing Sheets

FRONT VIEW BACK VIEW

FRONT VIEW BACK VIEW

Fig. 3A
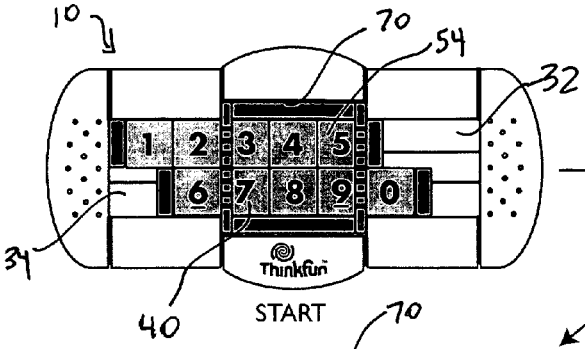
START
Fig. 3B
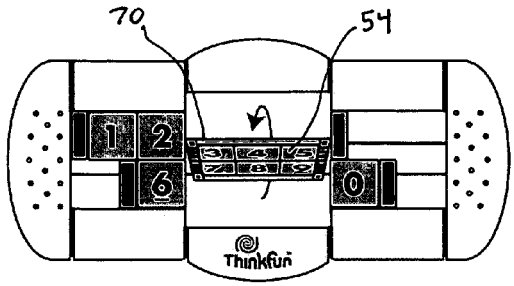
FLIPPING...
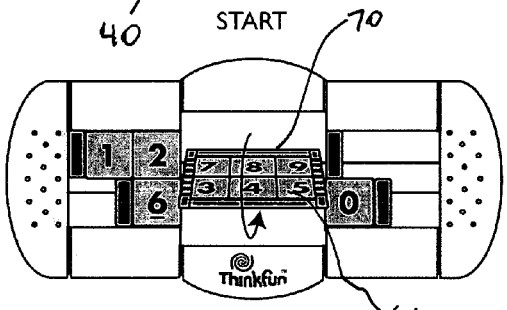
ALMOST DONE...
Fig. 3C
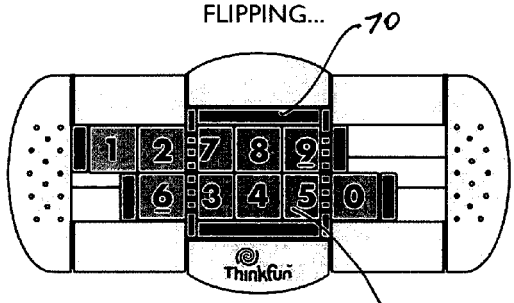
COMPLETE (top and bottom three numbers have been swapped)
Fig. 3D

PUZZLE GAME INCORPORATING A ROTATIONAL ELEMENT AND METHODS OF PLAYING THEREOF

BACKGROUND OF THE INVENTION

1. Field of the Invention

The invention is broadly directed to games, and more specifically to puzzle games of skill used by one or more players for enjoyment as well as for exercising the mind, wherein the puzzle game includes a rotational element to provide further challenges and solutions.

2. Description of the Related Art

There exist a large variety of game categories including card games, board games, multi-player games, single-player games, arcade games, computer games, and the like. Popular game categories include puzzles and "mind-games" where the player must strategize or think through various levels of challenges that are presented. The games can either be played alone or with others. In addition to enjoyment, the games develop valued attributes such as planning, critical thinking and strategic decision-making.

Some puzzles and mind-games are geared towards a younger audience, while others are directed at an older audience. It is difficult to create a game that combines simple rules with various levels of complexity that would appeal to young and old alike, and with diverse skill levels.

Accordingly, there is a continuing need and desire for puzzles and games that are fun to play, have a simple but efficient rule set, and that can continually challenge a wide range of users.

SUMMARY OF THE INVENTION

The present invention is directed to a puzzle game with a rotating element and methods of playing the game. One object of the present invention is to provide a unique puzzle that is fun to play, has simple and efficient rules, and provides ever-changing challenges to exercise the mind.

Another object is to create a puzzle game and method of playing that can be used and enjoyed by a wide variety of users, both in age and skill level.

To achieve these and other objects, the present invention provides a puzzle game, including a frame having a front facing portion and a rear facing portion, and a shaft extending from a first side of the frame to an opposing side of the frame along the horizontal axis, thereby defining a plurality of slide rows. A plurality of tiles are slideable along the horizontal axis within each of the plurality of slide rows, each of the plurality of tiles having a design on a front facing portion of the tile and an inverted form of the design on a rear facing portion of the tile. A sub-frame is rotatably mounted in the frame for rotating about the shaft, the sub-frame having a first dimension spanning the plurality of slide rows, and a second dimension spanning a sub-set of the plurality of tiles along the horizontal axis. When the player rotates the sub-frame by one-hundred eighty degrees during game play, some or all of the plurality of slide rows containing the sub-set of the plurality of tiles are oriented such that the rear facing portions of the sub-set of the plurality of tiles are viewable from the front facing portion of the frame, and the plurality of slide rows are inverted as viewed along the vertical axis.

When playing with the puzzle game, the player slides the first group of tiles, in one of the plurality of slide rows, left or right along the horizontal axis. Then the player slides the second group of tiles, in the other slide row, left or right along the horizontal axis independent of the first group of tiles. The player selectively rotates the sub-frame by one-hundred eighty degrees to orient the slide rows and corresponding tiles in a different position as viewed along the vertical axis. The sliding and rotating steps are repeated until the designs on the tiles are positioned in a logical or sequential pattern, after initially being oriented in a random pattern.

BRIEF DESCRIPTION OF THE DRAWINGS

The above objects and other advantages of the present invention will become more apparent by describing in detail the preferred embodiments thereof with reference to the attached drawings in which:

FIGS. 3A–3D are front and partial perspective views of the embodiment in FIG. 1, illustrating the operation of the rotational element of the puzzle game;

DETAILED DESCRIPTION OF PREFERRED EMBODIMENTS

The present invention will now be described more fully with reference to the accompanying drawings, in which preferred embodiments of the invention are shown. The invention may, however, be embodied in many different forms and should not be construed as being limited to the embodiments set forth herein. Rather, the embodiments are provided so that this disclosure will be thorough and complete, and will fully convey the concept of the invention to those skilled in the art.

Broadly described, the present invention relates to a puzzle game with an integrated rotational element, which increases the complexity of the game to provide enjoyment and promote critical and logical thinking through mental exercises. The ultimate objective of the exemplary "flipside" puzzle embodiment described in detail herein is to arrange all the numbered tiles into numerical order, after starting with the numbered tiles in a random order. This is accomplished by sliding the groups of tiles in the rows back and forth and selectively rotating the rotational element to change the orientation of the tiles in the rows.

Other flipside puzzle embodiments may include letters or symbols instead of numbers, two or more rows of numbers/letters/symbols, greater or lesser numbers of tiles, different numbers of fixed row positions, and different combinations of tiles that flip or rotate as described herein.

The structure of the puzzle, and the method of playing (both in person and online) will now be described in greater detail.

Figure 1A:
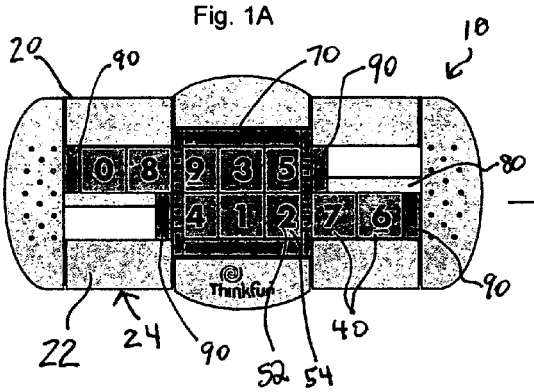
FIGS. 1A–1B are front views of an embodiment of the puzzle game components illustrating ten numbered tiles in two rows of five in an initial random-ordered state (FIG. 1A), and then in a final solved state in numerical order (FIG. 1B)
Figure 1B:
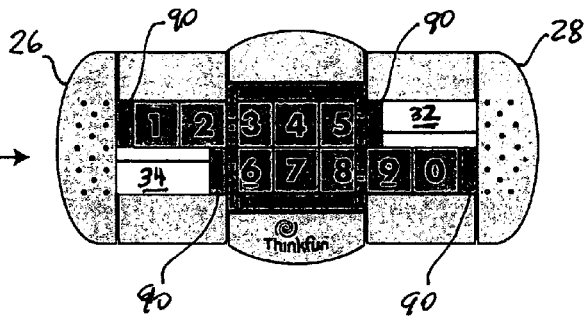
Figure 1C:
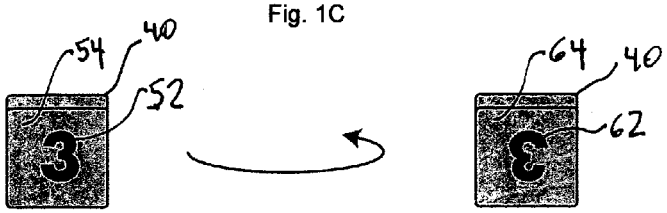
FIG. 1C provides front and rear views of an individual tile in the embodiment of FIG. 1A.

FIGS. 1A–1B are front views of an embodiment of the puzzle components, and FIG. 1C provides front and rear views of a single tile in the embodiment of FIG. 1A. FIG. 1A shows the puzzle in its original state with the numbered tiles arranged in a random or scattered pattern. FIG. 1B shows the puzzle in its final state where all the numbers are arranged in proper numerical sequence.

The puzzle game 10 includes a frame 20 having a front-facing portion 22 and a rear-facing portion 24. The frame 20 appears as a rectangle having a longer horizontal axis and a shorter vertical axis, but other shapes are contemplated within the scope of this invention, including cylindrical type frames. The frame 20 includes gripping platforms 26 and 28 on either side to facilitate handling the puzzle game 10 during play.

A plurality of slide rows 32 and 34 are arranged vertically as viewed in the drawing in FIG. 1B, and are movable horizontally from one side of the frame 20 to an opposing side of the frame 20. In the illustrated embodiment there are two slides rows 32 and 34, although more slide rows are contemplated within the scope of this invention.

Figure 4:
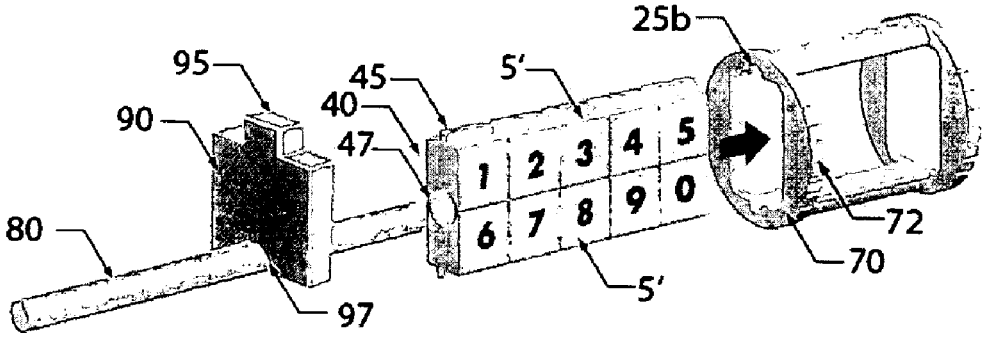
FIG. 4 is an exploded perspective view of some of the game pieces and how they are integrated for the puzzle game embodiment of FIG. 1.

A plurality of tiles 40 are slideable along the horizontal axis within each of the plurality of slide rows 32 and 34. Referring to FIG. 4, each of the tiles 40 has a protrusion 45, slideable within the frame 20, and a notch 47, communicating with a central shaft 80, to allow the tiles 40 to slide along the horizontal axis. Each of the tiles 40 may be individually slideable, but preferably they are slideable as a group, such that all tiles 40 in the slide row 32 or 34 move along the horizontal axis in unison. Therefore, as shown in FIG. 1A, all five of the tiles 40 in the upper row 32 slide as a group, and all five of the tiles 40 in the lower row 34 slides as a group. This group-sliding feature is facilitated by placing a tile stopper 90 at each end to bracket the tiles 40 in each slide row 32 and 34. Referring again to FIG. 4, each of the tile stoppers 90 contains a protrusion 95 slideable within the frame 20 and a notch 97 communicating with the shaft 80. Only one tile stopper 90 is shown in FIG. 4 for simplicity, but in this embodiment there would be four stoppers 90, one at each end of each slide row 32 and 34 as shown in FIGS. 1A and 1B.

Figure 2A:
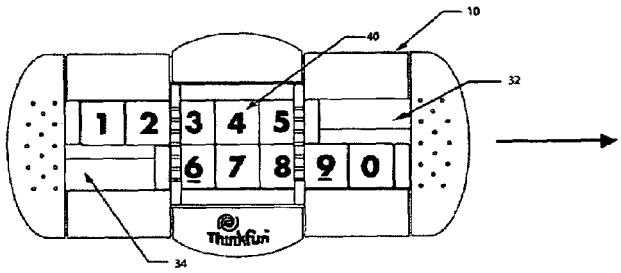
FIGS. 2A–2C are front views of the embodiment in FIG. 1 illustrating the various orientations or positions for the rows of tiles.
Figure 2B:
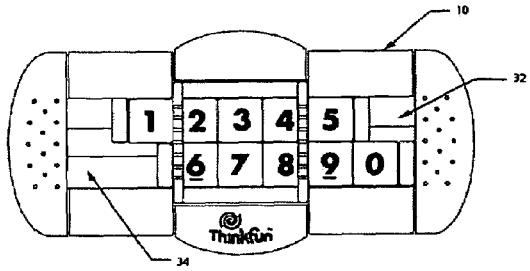
Figure 2C:
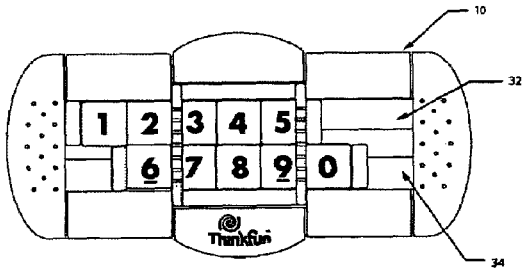

FIGS. 2A–2C are front views of the embodiment in FIG. 1 illustrating certain positions for the rows of tiles 40 sliding as a group. In progressing from FIG. 2A to FIG. 2B, the top slide row 32 has been moved one space (the width of one tile 40) to the right. In progressing from FIG. 2A to FIG. 2C, the bottom slide row 34 has been moved one space to the left. In the embodiment shown in FIGS. 2A–2C, there are essentially three possible positions of movement for each row (left, middle, right). The positions of movement, however, may be more or less, depending on the number of tiles and the size of the rotational element (discussed further below), so long as the positions of movement enable all the tiles in a given row to be positioned inside the rotational element. So, for example, if there were seven tiles per row and the rotational element were three tiles wide, there would be five positions of movement, including the center position.

Referring to FIG. 1C, note that each of the plurality of tiles 40 has a design 52 on a front-facing portion 54 of the tile 40 and an inverted form of the design 62 on a rear-facing portion 64 of the tile 40. As will be described later, this allows the player to flip a portion of the tiles 180 degrees, yet keep all the numbers facing in the same direction. As illustrated in FIGS. 1A and 1C, the design 52 is a conventional Arabic numeral, however, any type of design may be incorporated. For example, the designs can be Roman numerals or letters of the alphabet, either foreign or domestic. For numerals, the object of the game would be to arrange them in numerical sequence after starting from a random sequence. For alphabet characters, the object would be to arrange them in alphabetical order after starting from a random order. In addition, the designs can be geometric shapes or other symbols that are arranged in logical patterns, as for example, to mimic a particular pattern defined by a teacher or appearing in a puzzle book.

Referring to FIGS. 3A–3D, there are shown front and partial perspective views of the embodiment in FIG. 1, illustrating the operation of the rotational element of the puzzle game 10. The puzzle game 10 includes sub-frame 70 that is rotatably mounted in the frame 20 for rotating about the shaft 80 (the horizontal axis) and in a direction defined by the vertical axis as shown in the sequence from FIG. 3A to FIG. 3B. The rotating sub-frame 70 has a first dimension along the vertical axis spanning the plurality of slide rows 32 and 34, and a second dimension along the horizontal axis spanning a subset of the plurality of tiles 40. In the illustrated embodiment, the rotating sub-frame 70 encompasses two slide rows and three tiles in each row for a total of six tiles. These six tiles (3-4-5 on the top and 7-8-9 on the bottom) can be rotated around the horizontal axis of the puzzle game 10. As this sub-frame 70 is rotated 180 degrees, the numbers/tiles on the top and bottom switch places as shown in the sequence of FIGS. 3A–3D, and taking into account the inverted nature of the designs on the tiles 40 as shown in FIG. 1C. FIG. 3A shows the tiles 40 in their initial position, and FIG. 3B shows the six center tiles 40 in sub-frame 70 as they begin their 180 degree rotation where we can still see the front-facing portions 54 of the tiles 40. In FIG. 3C, the sub-frame 70 is rotated past the 90 degree point, and we can begin to see the rear-facing portions 64 of the tiles 40. FIG. 3D shows the sub-frame 70 after it has been rotated the entire 180 degrees, thereby illustrating the six tiles that have been inverted (now 7-8-9 on the top and 3-4-5 on the bottom).

During game play, the tiles 40 in the slide rows 32 and 34 are shifted left and right, and the sub-frame 70 is selectively rotated. These steps are repeated until all the designs (numbers, letters or symbols), which were originally in random or scattered patterns, are arranged in logical sequences depending on the design (numerical sequence, alphabetical sequence, logical patterns, etc.).

While the illustrated embodiments show ten numbered tiles in two rows of five and a central rotating sub-frame 70, one of ordinary skill in the art could readily adapt this novel invention to other embodiments.

For example, the puzzle game 10 could have more than two slide rows of tiles. As a practical matter, however, two slide rows of tiles is preferred because additional slide rows would complicate the engineering and manufacturing process, and for any odd-number of slide rows, the center row of tiles would not change positions as the sub-frame rotates 180 degrees. In addition, the sequencing challenge may be too much for the ordinary user to enjoy.

The number of tiles 40 in each slide row may be increased or decreased, and the individual tiles 40 in each slide row may be individually movable, movable as a group, or have a sub-set of adjacent tiles 40 that are individually movable.

The number of possible positions of movement for each slide row can be increased or decreased as well. For example, as describe previously, in the embodiment shown in FIGS. 2A–2C, there were essentially three possible positions of row movement for each row (left, middle, right), since there were five tiles 40 per slide row, and the sub-frame 70 accommodated three adjacent tiles 40 at a time. The positions of row movement should be set so that all the tiles 40 in a given slide row can at one point or another be positioned inside the width of the rotating sub-frame 70. So, for example, if there were seven tiles 40 per row and the rotating sub-frame 70 was three tiles 40 wide, there would be five positions of row movement, including the center position. The rotating sub-frame 70 may also encompass a greater or lesser number of adjacent tiles 40 that "flip" or "rotate." Further, the sub-frame 70 may be oriented in a different position than the central position depicted in the drawings, for example, the sub-frame 70 may be oriented closer to one side of the frame than the other.

Figure 5:
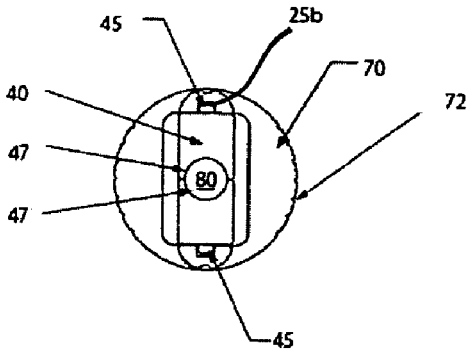
FIG. 5 is a side cross-sectional view taken along the line 5'–5' in FIG. 4.
Figure 6:
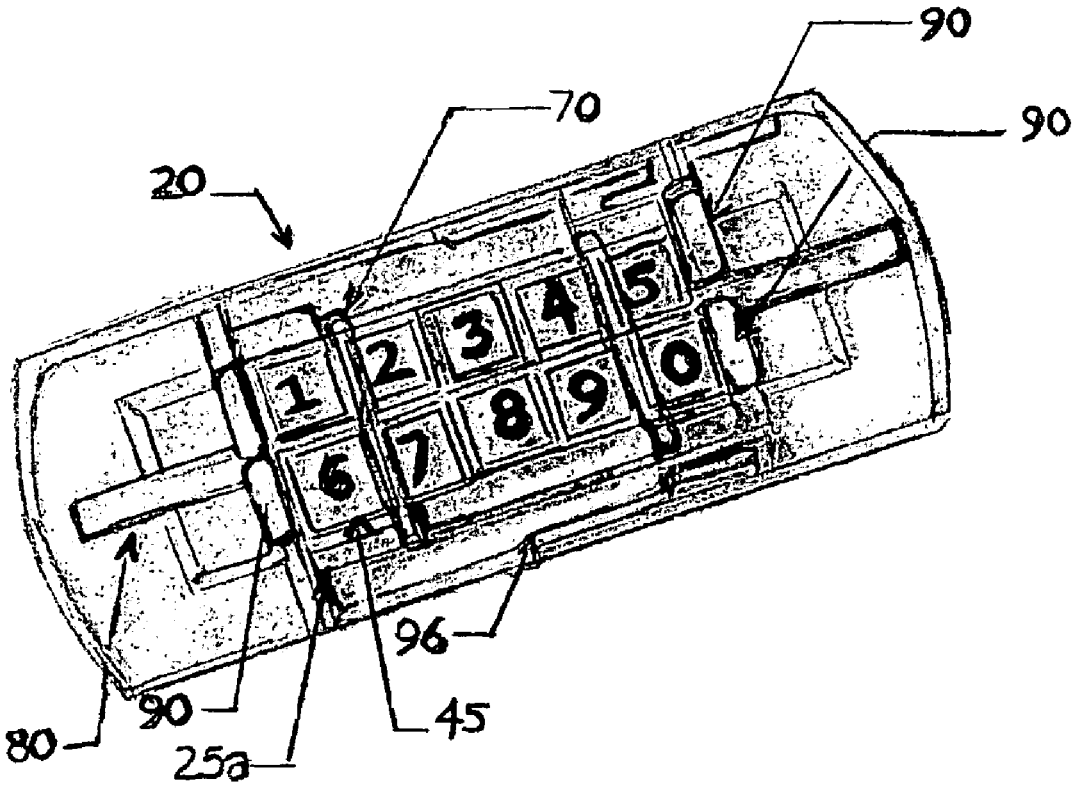
FIG. 6 is a partial front perspective view illustrating how the shaft and rotating element fit within the frame of the embodiment of FIG. 1.

A more detailed description of the game pieces, and there structural relationship, follows with reference to FIGS. 4 through 6. FIG. 4 is an exploded perspective view of the game pieces and FIG. 5 is a side cross-sectional view taken along the line 5'–5' in FIG. 4. FIG. 6 is a partial front perspective view illustrating how the shaft 80, tiles 40, and rotating element 70 fit within a bottom portion of the frame 20.

As shown in FIG. 4 and FIG. 5, each of the tiles 40 contains a means for enabling the tiles 40 to slide within the frame 20, and a means for enabling the tiles 40 to slide along the shaft 80. In this embodiment, each tile 40 contains a protrusion 45 at a one end, which communicates with a corresponding channel 25*a* in the frame 20 (see FIG. 6) and a corresponding channel 25*b* in the rotating sub-frame 70 (see FIG. 4), to ensure smooth sliding of the tiles 40 along the frame 20. Each tile 40 also contains a semicircular notch 47 at the opposing end. The notch 47 mates with the shaft 80 to ensure smooth sliding along the shaft 80. The interaction of the notches 47 and shaft 80, together with channels 25*a*, 25*b* and protrusions 45, enable the tiles 40 to slide freely while keeping the game pieces intact.

FIG. 6 illustrates how the shaft 80 is oriented within the frame 20, and how the shaft 80 is threaded through the rotating sub-frame 70 to carry out the purpose of the puzzle game 10. The rotating sub-frame 70 may also include ridges or undulations 72 to facilitate spinning the rotating sub-frame during game play as shown in FIG. 4.

FIG. 4 also illustrates one of the four tile stoppers 90 that are located at each end of each slide row 32 and 34. The stopper protrusion 95 and stopper notch 97, respectively communicate with the channel 25*a* in the frame 20 and the shaft 80, in the same way as the tiles 40. The tile stoppers 90 are preferably wider than the tiles 40 to facilitate handling during game play, as well as facilitating keeping the tiles 40 in the row intact. As shown more clearly in FIG. 6, each pair of stoppers 90 along the slide row is interconnected using a bridging element 96. Note that the bridging element 96 is positioned toward the outer edge of the frame 20 so as not to interfere with the motion of the rotating sub-frame 70 or the sliding of the tiles 40.

In addition to playing the game with a physical puzzle, the game concept and method of play could also be replicated and played with slight modifications on a computer, whether a stand-alone computer, via the Internet, or via a portable computerized device such as a GameBoy®, cell phone, or personal digital assistant (PDA).

Figure 7:
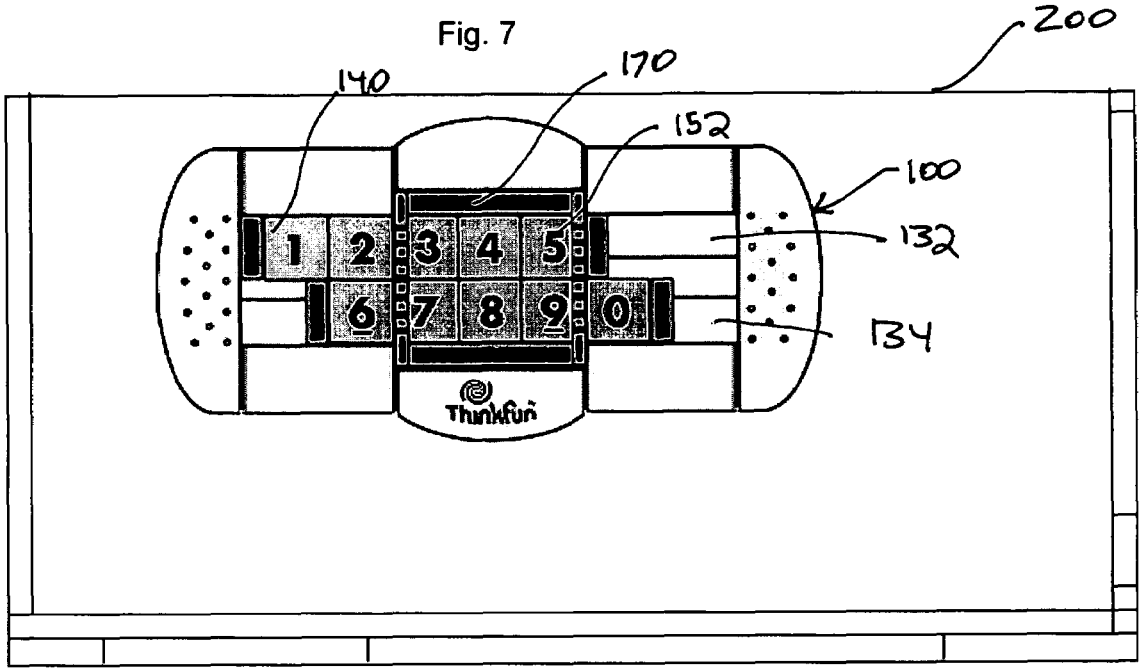
FIG. 7 is an exemplary embodiment of a computer version of the puzzle game embodiment of FIG. 1.

In the computer version of the game as shown in FIG. 7, there is provided a graphic of the puzzle game 100 on a video display of a computer 200, including a plurality of slide rows 132 and 134 extending horizontally across the video display, and a plurality of tiles 140 slideable as a group within each of the plurality of slide rows 132 and 134. Each of the plurality of tiles 140 has a design 152 thereon, wherein the designs 152 are initially oriented in a random or scattered pattern. A selection box 170 has a vertical dimension spanning the plurality of slide rows 132 and 134 and a horizontal dimension spanning a pre-determined plurality of tiles 140.

To play the computer game, the player would slide the first group of tiles 140 in slide row 132 left or right using a suitable input device (not shown) to select and drag the first group of tiles in the desired direction. They player can then slide the other group of tiles 140 in slide row 134 left or right using the input device to select and drag the other group of tiles 140 in the desired direction. The player could then select or highlight the inversion box 170 by using the input device, whereby the slide rows 132 and 134 and corresponding tiles 140 appearing with the inversion box 170 would be inverted, corresponding to the operation of the rotating sub-frame 70 in the physical embodiment. The computerized sliding and selecting/inverting steps are repeated until the designs on the tiles are positioned in a logical or sequential pattern.

The online game proceeds in the same fashion, with the same rules, as described above with regard to the physical game.

Gaming continues to be a growing industry and there is always a need for new games that players will enjoy and will continue to play. It is important that any new game have rules that are easy to understand, as well as multiple opportunities to achieve the desired goal.

While the present invention has been described in detail with reference to the preferred embodiments thereof, it should be understood to those skilled in the art that various changes, substitutions and alterations can be made hereto without departing from the scope of the invention as defined by the appended claims.

What is claimed is:

1. A puzzle game, comprising:

a frame having a front facing portion and a rear facing portion positioned along a first axis, and a second axis perpendicular to the first axis;

a shaft extending from a first side of the frame to an opposing side of the frame along the first axis, thereby defining a plurality of slide rows;

a plurality of tiles slideable along the first axis within each of the plurality of slide rows, each of the plurality of tiles having a design on a front facing portion of the tile and an inverted form of the design on a rear facing portion of the tile; and a sub-frame, rotatably mounted in the frame for rotating about the shaft and in a direction defined by the second axis, the sub-frame having a first dimension spanning the plurality of slide rows along the second axis, and a second dimension spanning a sub-set of the plurality of tiles along the first axis, wherein by rotating the sub-frame by one-hundred eighty degrees, some or all of the plurality of slide rows containing the sub-set of the plurality of tiles are oriented such that the rear facing portions of the sub-set of the plurality of tiles are viewable from the front facing portion of the frame, and the plurality of slide rows are oriented in a different position as viewed along the second axis.

2. The puzzle game of claim 1, further comprising a gripping platform integrally formed on the respective sides of the frame to facilitate handling the puzzle.

3. The puzzle game of claim 2, wherein the frame is rectangular.

4. The puzzle game of claim 1, wherein the plurality of slide rows equals two.

5. The puzzle game of claim 1, wherein the design on each of the plurality of tiles is a number.

6. The puzzle game of claim 1, wherein the design on each of the plurality of tiles is a letter of an alphabet.

7. The puzzle game of claim 1, wherein the design on each of the plurality of tiles is a symbol.

8. The puzzle game of claim 1, wherein the plurality of tiles in each of the plurality of slide rows slide independently of other of the slide rows, and the plurality of tiles in each slide row slide along the first axis as a group.

9. The puzzle game of claim 8, further comprising a tile stopper disposed at respective ends of each slide row, the tile stoppers for each slide row being interconnected to ensure the plurality of tiles in each slide row slide along the first axis as a group.

10. The puzzle game of claim 1, wherein the sub-frame is oriented in a central position with reference to the first and second axes.

11. The puzzle game of claim 1, wherein the plurality of slide rows equals two, the plurality of tiles in each slide row equals five, and wherein the sub-frame's first dimension spans the two slide rows along the second axis, and the sub-frame's second dimension spans three tiles along the first axis, whereby rotation of the sub-frame causes the two slide rows to switch positions as viewed along the second axis.

12. A method of playing a puzzle game, the method comprising:

providing a frame having a front facing portion and a rear facing portion positioned along a first axis, and a second axis perpendicular to the first axis;

providing a plurality of slide rows extending from a first side of the frame to an opposing side of the frame along the first axis;

providing a plurality of tiles slideable as a group along the first axis within each of the plurality of slide rows, each of the plurality of tiles having a design on a front facing portion of the tile and an inverted form of the design on a rear facing portion of the tile, wherein the designs are initially oriented in a random or scattered pattern;

providing a sub-frame, rotatably mounted in the frame for rotating about the first axis and in a direction defined by the second axis, the sub-frame having a first dimension spanning the plurality of slide rows along the second axis, and a second dimension spanning a sub-set of the plurality of tiles along the first axis;

sliding a first group of tiles, in one of the plurality of slide rows, left or right along the first axis;

sliding an other group of tiles, in another of the plurality of slide rows, left or right along the first axis independent of the first group of tiles;

rotating the sub-frame by one-hundred eighty degrees to selectively orient the slide rows and corresponding tiles in a different position as viewed along the second axis; and repeating the sliding and rotating steps until the designs on the tiles are positioned in a logical or sequential pattern.

* * * * *